US006135086A

United States Patent [19]

Clarke et al.

[11] Patent Number: 6,135,086

[45] Date of Patent: Oct. 24, 2000

[54] INTERNAL COMBUSTION ENGINE WITH ADJUSTABLE COMPRESSION RATIO AND KNOCK CONTROL

[75] Inventors: James Ryland Clarke, Northville; Rodney John Tabaczynski, Saline, both of Mich.

[73] Assignee: Ford Global Technologies, Inc., Dearborn, Mich.

[21] Appl. No.: 09/232,233

[22] Filed: Jan. 19, 1999

[51] Int. Cl.[7] ..... F02B 75/02

[52] U.S. Cl. ..... 123/316; 123/435

[58] Field of Search ..... 123/78 D, 316, 123/435

[56] References Cited

U.S. PATENT DOCUMENTS

| | | | |
|---|---|---|---|
| 1,252,269 | 1/1918 | Johnson . | |
| 2,170,266 | 8/1939 | Leissner . | |
| 2,376,214 | 5/1945 | Webster . | |
| 2,446,348 | 8/1948 | Webster . | |
| 3,450,111 | 6/1969 | Cronstedt . | |
| 3,934,560 | 1/1976 | Dodd . | |
| 3,964,452 | 6/1976 | Nakamura et al. | 123/78 D |
| 4,016,841 | 4/1977 | Karaba et al. . | |
| 4,191,135 | 3/1980 | Nohira et al. | 123/316 |
| 4,406,260 | 9/1983 | Burley | 123/316 |
| 4,510,895 | 4/1985 | Slee . | |
| 5,101,776 | 4/1992 | Ma | 123/78 D |
| 5,476,072 | 12/1995 | Guy . | |
| 5,476,074 | 12/1995 | Boggs et al. . | |
| 5,755,192 | 5/1998 | Brevick | 123/78 B |
| 5,970,944 | 10/1999 | Kawamura | 123/316 |

FOREIGN PATENT DOCUMENTS

| | | |
|---|---|---|
| 994044 | 11/1951 | France . |
| 1153247 | 3/1958 | France . |
| 1217378 | 5/1960 | France . |
| 401855 | 2/1943 | Italy . |
| 7169 | 8/1907 | United Kingdom . |
| 235676 | 6/1925 | United Kingdom . |
| WO98/10179 | 3/1998 | WIPO . |

*Primary Examiner*—John Kwon
*Attorney, Agent, or Firm*—Jerome R. Drouillard

[57] ABSTRACT

A reciprocating internal combustion engine includes a variable compression ratio system for adjusting the compression ratio of an engine in a first compression range located about a first predetermined compression ratio in the event that the engine is operating at a first predetermined load range, with the variable compression ratio adding a fixed clearance volume to the volume of the combustion chamber in the event that the engine is operating in a knocking condition beyond the range of the first compression range.

8 Claims, 2 Drawing Sheets

INTERNAL COMBUSTION ENGINE WITH ADJUSTABLE COMPRESSION RATIO AND KNOCK CONTROL

FIELD OF THE INVENTION

The present invention relates to an internal combustion engine having a system for controlling knock.

DISCLOSURE INFORMATION

Engine designers have sought to improve reciprocating engine performance through the use of variable or adjustable compression ratio. Such devices typically include pistons having variable compression height. Unfortunately, variable compression height pistons are heavy and therefore undesirably increase reciprocating mass in an engine. Also, such pistons are difficult to control. A system according to the present invention allows fine adjustment of compression ratio about a fixed point combined with the ability to grossly lower compression ratio so as to provide a robust system for controlling engine knock.

SUMMARY OF THE INVENTION

A reciprocating internal combustion engine includes a cylinder formed within a cylinder block, a piston slidably mounted within the cylinder and attached to a crankshaft by means of a connecting rod, a cylinder head mounted upon the cylinder block so as to close an upper end of the cylinder, and intake and exhaust valves for admitting charge into the cylinder and allowing combustion gases to leave the combustion chamber. In this specification, the term "combustion chamber" refers to the space defined by the cylinder head, the piston crown, and the adjacent cylinder wall. A variable compression ratio system according to the present invention adjusts the compression ratio of the engine in a first compression range located about a first predetermined compression ratio in the event that the engine is operating at a first predetermined load range, with the variable compression ratio system further adjusting the compression ratio to a fixed value which is outside the first compression range in response to a sensed value of an engine operating parameter. The compression ratio may be varied within the first compression range in response to sensed engine knock such that when knock is sensed, the variable compression ratio system reduces the engine's compression ratio. The present variable compression ratio system may be employed to alternately increase and decrease the compression ratio within a first compression range until the engine is operating at the greatest possible compression ratio without exceeding a predetermined level of knocking. An engine may be operated within the first compression range in the event that the load upon the engine is less than a first predetermined threshold, with the engine being operated at a compression ratio which is less than a minimum compression ratio value within the first compression range in the event the load upon the engine is greater than a second predetermined threshold. According to an aspect of the present invention, the first predetermined compression ratio may be approximately 12:1, with the fixed value of a lower compression ratio being approximately 8:1. Those skilled in the art will appreciate in view of this disclosure that these compression ratio values are merely exemplary; the precise compression ratios achievable by a system according to the present invention may be selected to suit any particular engine being construction according to this invention.

According to another aspect of the present invention, a controller receives outputs from a plurality of sensors which sense a plurality of engine operating parameters, with the controller determining a desired compression ratio for operating the engine and for operating a compression adjuster which sets the compression ratio at the predetermined desired compression ratio. The compression adjuster may comprise a motor driven cam which bears upon a plunger slidably mounted within a bore formed within the cylinder head such that the clearance volume of the cylinder may be increased or decreased as the cam is positioned by the motor. In essence, the plunger has a first stable state in which minor adjustments are made in the clearance volume by sliding the plunger so as to allow the engine to be operated below a predetermined level of knock at a compression ratio suitable for part throttle operation as well as a second stable state in which the plunger is withdrawn to a location in the bore in which the clearance volume of the combustion chamber is increased to an extent necessary to permit knock free operation at full load.

DETAILED DESCRIPTION OF PREFERRED EMBODIMENT(S)

Figure 1:
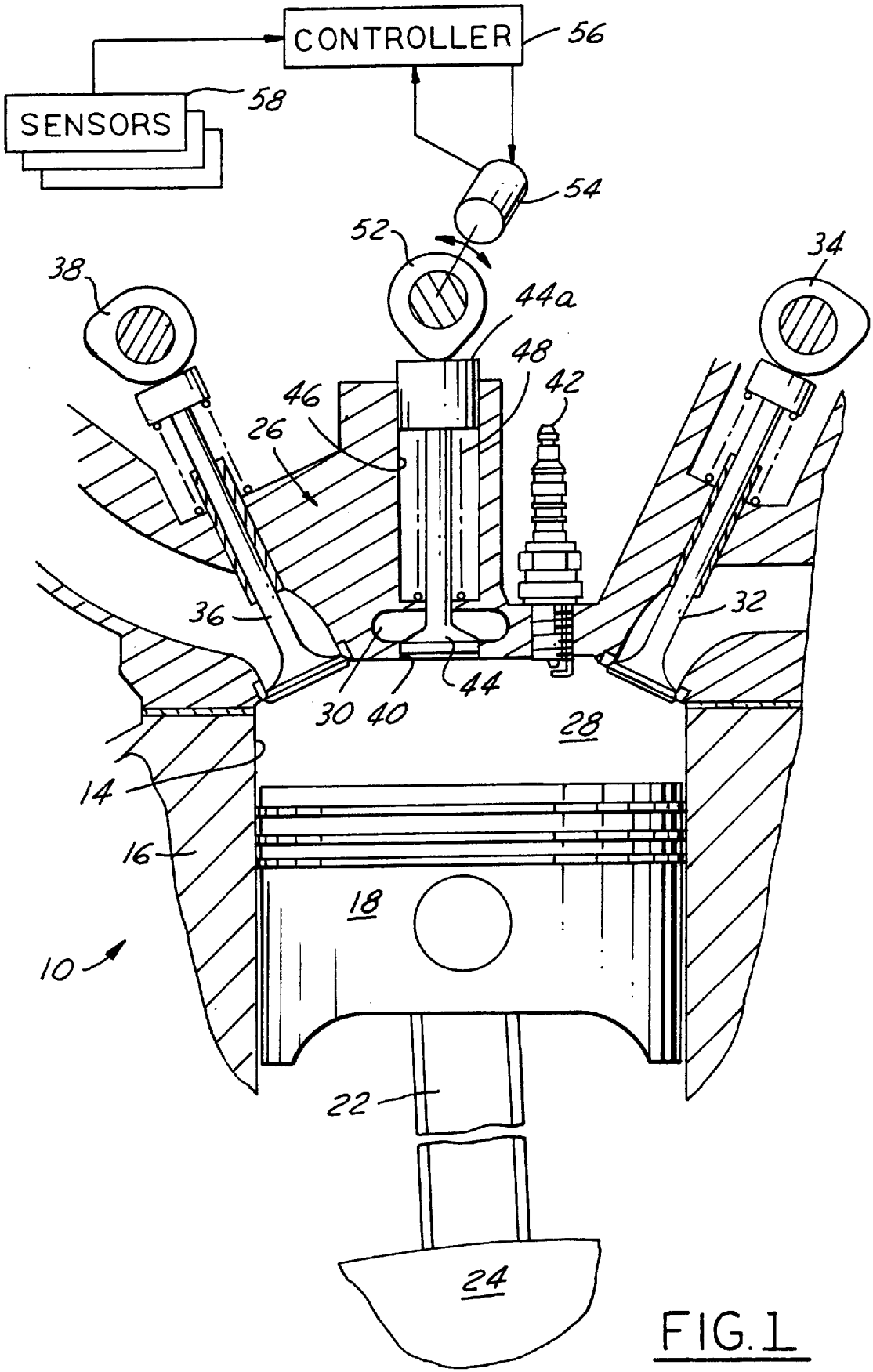
FIG. 1 is a schematic representation of an engine having an adjustable compression ratio and knock control system according to the present invention.

As shown in FIG. 1, engine 10 has cylinder 14 contained within cylinder block 16. Piston 18 is slidably mounted within cylinder 14 and connected with crankshaft 24 by means of connecting rod 22. Although but one cylinder is illustrated in FIG. 1, an engine according to the present invention could have any number of cylinders. Combustion chamber 28 is defined by piston 18, cylinder wall 14, and cylinder head 26. In conventional fashion, spark plug 42 initiates combustion within combustion chamber 28. It should be noted however, that the present invention could be practiced with engines utilizing compression ignition as well as spark ignition.

Fresh charge is admitted to combustion chamber 28 by means of intake valve 32, which is operated by intake camshaft 34. Conversely, spent gases are exhausted from the engine by means of exhaust valve 36, which is operated by camshaft 38. Controller 56 receives a variety of inputs from a plurality of sensors 58 which may include, for example, throttle position, engine speed, intake manifold pressure, exhaust gas temperature, exhaust gas pressure, exhaust gas oxygen, air/fuel ratio, throttle position, spark timing, engine knock, cylinder pressure, and other parameters known to those skilled in the art and suggested by this disclosure. Controller 56 is drawn from a class of engine controllers known to those skilled in the art and suggested by this disclosure. Controller 56 operates motor 54 which positions cam 52 upon plunger 44. Cam 52 contacts surface 44*a* as cam 52 rotates and stops to a position as set by motor 54. Motor 54 can be a torque or stepper motor, or other type of rotary positioning device known to those skilled in the art and suggested by this disclosure.

Figure 2:
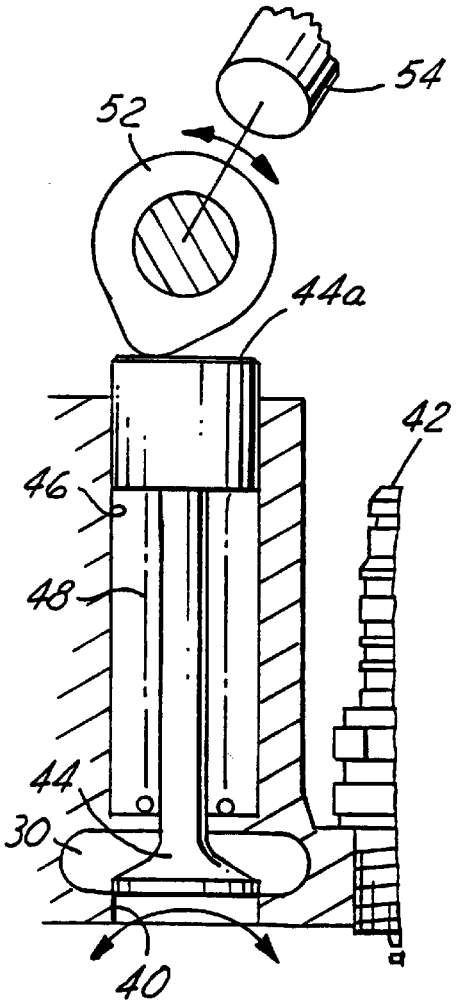
FIGS. 2 and 3 illustrate various positions of a compression adjuster according to one aspect of the present invention.
Figure 3:
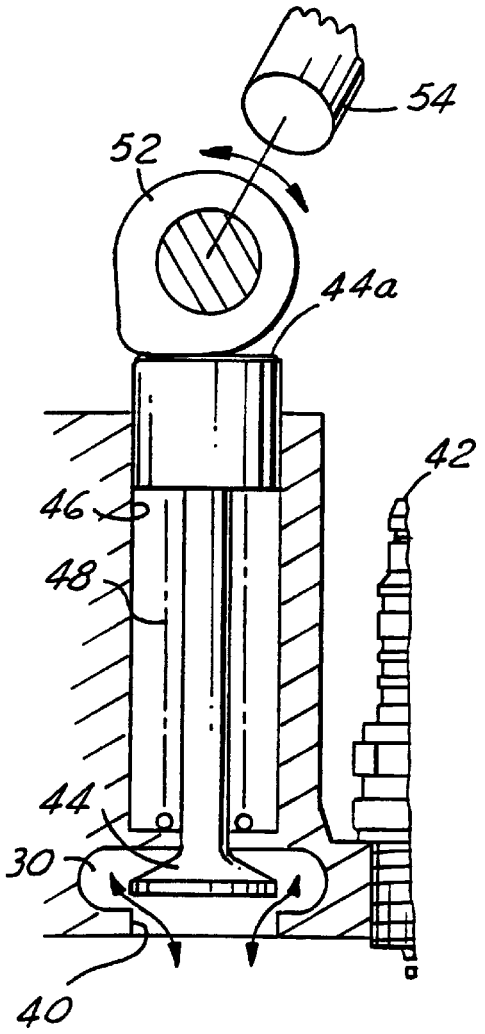

FIGS. 2 and 3 illustrate two of the primary positions of a variable compression ratio system according to the present invention. Notice that in FIG. 2, plunger 44 is withdrawn within bore 46 to the point that plunger 44 defines a cylindrical recess 40 which is in effect a supplemental clearance volume available into which the intake charge and combustion gases may flow so as to change or adjust the clearance volume of engine 10. As used in this specification, the term "clearance volume" is defined to mean the space occupied by the air/fuel charge when the engine's crankshaft is at top dead center.

In essence, the position of plunger 44 within bore 46 is varied by controller 56 so that the size of cylindrical volume 40 is changed or adjusted so as to allow adjustment of the compression ratio of engine 10 in a range located about a first predetermined ratio, say 12:1, in the event that the engine is operating at light to medium load in which knock is not a problem. The range about the nominal compression ratio could be about one compression ratio on either side of the nominal value. Controller 56 may be used to alternately increase and decrease the compression ratio by repositioning plunger 44 so as to achieve the greatest compression ratio, consistent with knock below an acceptable threshold.

If controller 56 determines the engine is either knocking excessively or running at high loads which could generate knock at a level necessitating adjustment of the clearance volume beyond the first predetermined compression ratio range, plunger 44 will be withdrawn to the point illustrated in FIG. 3. Note that cam 52 is almost on its base circle location in FIG. 3, with the result that plunger 44 moves up sufficiently to allow supplemental clearance cavity 30 to be coupled with combustion chamber 28. Note that when plunger 44 is in the position shown in FIG. 3, the added clearance volume provided by supplemental clearance cavity 30 is a fixed value. This added clearance volume will be sufficient to operate engine 10 at a lower compression ratio, say 8:1 or some other clearly lower value at which knocking can be readily controlled. Thus, plunger 44 may be said to be multistable, because it has a first stable position as illustrated in FIG. 2 and a second stable position as illustrated in FIG. 3.

While the invention has been shown and described in its preferred embodiments, it will be clear to those skilled in the arts to which it pertains that many changes and modifications may be made thereto without departing from the scope of the invention.

What is claimed is:

1. A reciprocating internal combustion engine comprising:

a cylinder formed within a cylinder block;

a piston slidably mounted within the cylinder and attached to a crankshaft by means of a connecting rod;

a cylinder head mounted upon the cylinder block so as to close an upper end of the cylinder, with said cylinder head, said piston, and said cylinder forming a combustion chamber;

at least one intake valve for admitting charge into the cylinder;

at least one exhaust valve for allowing combustion gases to leave the combustion chamber; and a variable compression ratio system for adjusting the compression ratio of the engine in a first compression range located about a first predetermined compression ratio in the event that the engine is operating at a first predetermined load range with said variable compression ratio system further adjusting the compression ratio to a fixed value which is outside said first compression range in response to a sensed value of an engine operating parameter wherein the compression ratio is varied within said first compression range in response to sensed engine knock such that when knock is sensed, the variable compression ratio system reduces the engine's compression ratio.

2. An engine according to claim 1, wherein the variable compression ratio system alternately increases and decreases the compression ratio within the first range until the engine is operating at the greatest possible compression ratio without exceeding a predetermined level of knocking.

3. An engine according to claim 1, wherein said engine is operated within the first compression range in the event that the load upon the engine is less than a first predetermined threshold, with said engine being operated at a compression ratio which is less than a minimum compression ratio value within said first compression range in the event that the load upon the engine is greater than a second predetermined threshold.

4. An engine according to claim 1, wherein said first predetermined compression ratio is approximately 12:1.

5. An engine according to claim 1, wherein said fixed value of said compression ratio is approximately 8:1.

6. An engine according to claim 1, wherein said variable compression ratio system comprises:

a controller for receiving outputs from a plurality of sensors which sense a plurality of engine operating parameters, with said controller also determining a desired compression ratio for operating the engine; and a compression adjuster operated by said controller for setting the compression ratio at the determined desired compression ratio.

7. An engine according to claim 6, wherein said compression adjuster comprises a motor driven cam which bears upon a plunger slidably mounted within a bore formed within said cylinder head such that the clearance volume of the cylinder is adjusted according to the position of the cam, as set by the motor in response to a command from said controller.

8. An engine according to claim 7, wherein said compression adjuster is multistable, with said plunger having at least a first stable state in which minor adjustments are made in the clearance volume by sliding the plunger so as to allow the engine to be operated below a predetermined level of knock at a compression ratio suitable for part throttle operation, and a second stable state in which the plunger is withdrawn to a location in the bore in which the clearance volume of the combustion chamber is increased to an extent necessary to permit knock-free operation at full load.

* * * * *